US012655613B2

(12) United States Patent
Noda et al.

(10) Patent No.: US 12,655,613 B2
(45) Date of Patent: Jun. 16, 2026

(54) WORKING AREA SETTING SYSTEM AND OPERATION TARGET DETECTION SYSTEM

(71) Applicant: KOBELCO CONSTRUCTION MACHINERY CO., LTD., Hiroshima (JP)

(72) Inventors: Daisuke Noda, Hiroshima (JP); Nobuhiro Fukuo, Hiroshima (JP); Masaki Akiyama, Hiroshima (JP); Sho Fujiwara, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 431 days.

(21) Appl. No.: 18/246,863

(22) PCT Filed: Jul. 9, 2021

(86) PCT No.: PCT/JP2021/025905
§ 371 (c)(1),
(2) Date: Mar. 28, 2023

(87) PCT Pub. No.: WO2022/064813
PCT Pub. Date: Mar. 31, 2022

(65) Prior Publication Data

US 2023/0383500 A1 Nov. 30, 2023

(30) Foreign Application Priority Data

Sep. 28, 2020 (JP) ..... 2020-161752
Apr. 6, 2021 (JP) ..... 2021-064927

(51) Int. Cl.
*E02F 9/26* (2006.01)
*E02F 3/32* (2006.01)
*E02F 3/43* (2006.01)

(52) U.S. Cl.
CPC ..... *E02F 9/262* (2013.01); *E02F 3/32* (2013.01); *E02F 3/435* (2013.01)

(58) Field of Classification Search
CPC ... E02F 9/262; E02F 3/32; E02F 3/435; E02F 3/437
See application file for complete search history.

(56) References Cited

U.S. PATENT DOCUMENTS 6,275,757 B1 * 8/2001 Watanabe ..... E02F 9/2296 37/234
7,532,967 B2 * 5/2009 Fujishima ..... E02F 9/265 701/50

(Continued)

FOREIGN PATENT DOCUMENTS

CN 108130933 A 6/2018
EP 3 779 071 A1 2/2021

(Continued)

OTHER PUBLICATIONS

International Search Report issued Sep. 28, 2021 in PCT/JP2021/025905, filed on Jul. 9, 2021, 2 pages.

(Continued)

*Primary Examiner* — Russell Frejd
(74) *Attorney, Agent, or Firm* — Oblon, McClelland, Maier & Neustadt, L.L.P.

(57) ABSTRACT

A technology that further facilitates automatic driving control of working machines includes a working area setting system that includes an area setting unit. The area setting unit is provided to set a working area. The working area is a predetermined range in which an operation target of a working machine is stacked.

11 Claims, 13 Drawing Sheets

(56) References Cited

U.S. PATENT DOCUMENTS

| | | | | |
|---|---|---|---|---|
| 9,377,779 | B2 * | 6/2016 | Tojima | G05D 1/0297 |
| 11,540,437 | B2 * | 1/2023 | Yagyu | A01C 17/006 |
| 2013/0182066 | A1 * | 7/2013 | Ishimoto | E02F 9/261 348/38 |
| 2016/0215475 | A1 * | 7/2016 | Meguriya | E02F 9/2285 |
| 2020/0385958 | A1 | 12/2020 | Seki et al. | |
| 2021/0012163 | A1 | 1/2021 | Li et al. | |
| 2021/0355651 | A1 | 11/2021 | Itoh et al. | |

FOREIGN PATENT DOCUMENTS

| | | | |
|---|---|---|---|
| EP | 3 922 776 | A1 | 12/2021 |
| JP | 4-136324 | A | 5/1992 |
| JP | 2019-178599 | A | 10/2019 |
| JP | 2019-190193 | A | 10/2019 |
| JP | 2020-86779 | A | 6/2020 |
| WO | WO 2019/189888 | A1 | 10/2019 |
| WO | WO 2020/162428 | A1 | 8/2020 |

OTHER PUBLICATIONS

Japanese Office Action issued Jul. 2, 2024 in Japanese Patent Application No. 2021-064927 (with English translation), 6 pages.
Extended European Search Report issued Feb. 13, 2024 in European Patent Application No. 21871945.8, 8 pages.
Japanese Office Action issued on Nov. 26, 2024 in Japanese Patent Application No. 2021-064927 (with English translation), 7 pages.
Japanese Office Action issued on Feb. 4, 2025 in Japanese Patent Application No. 2021-064927 (with English translation), 6 pages.
International Preliminary Report on Patentability and Written Opinion issued Mar. 28, 2023 in PCT/JP2021/025905 (submitting English translation only), 8 pages.
Combined Chinese Office Action and Search Report issued Aug. 16, 2025 in Chinese Patent Application No. 202180066373.7 with English translation, 18 pgs.
Japanese Decision of Refusal issued May 7, 2025 in Japanese Patent Application No. 2021-064927 with English translation, 5 pgs.
Office Action issued Feb. 13, 2026, in Chinese Patent Application No. 202180066373.7, with English translation, citing document 1.

* cited by examiner

WORKING AREA SETTING SYSTEM AND OPERATION TARGET DETECTION SYSTEM

TECHNICAL FIELD

The present invention relates to a working area setting system and an operation target detection system.

BACKGROUND ART

In regard to a technology of detecting an operation target in automatic driving technologies of working machines, Patent Literature 1 recites a technology of calculating the distance from a wheel loader to a natural ground that is an excavation target or an angle of repose of the natural ground, based on measurement data of a three-dimensional measurement device.

CITATION LIST

Patent Literatures

[Patent Literature 1] Japanese Laid-Open Patent Publication No. 2019-178599

SUMMARY OF INVENTION

Technical Problem

Assume that, for example, there are plural natural grounds within a detection area of a three-dimensional measurement device. In this case, it is difficult by the technology recited in Patent Literature 1 to specify a calculation target range of the excavation target. As a result, it may be difficult to perform automatic driving control of a working machine.

An object of the present invention is to provide a working area setting system that facilitates automatic driving control of a working machine.

Solution to Problem

A working area setting system comprises an area setting unit which is configured to set a predetermined range of a working area where an operation target of a working machine is stacked.

Advantageous Effects of Invention

This arrangement further facilitates automatic driving control of working machines.

DESCRIPTION OF EMBODIMENTS

First Embodiment

The following will describe an embodiment of the present invention with reference to figures. The description below assumes that a working machine is a hydraulic excavator 1. A working area setting system and an operation target detection system of First Embodiment will be described.

(Structure of Hydraulic Excavator)

Figure 1:
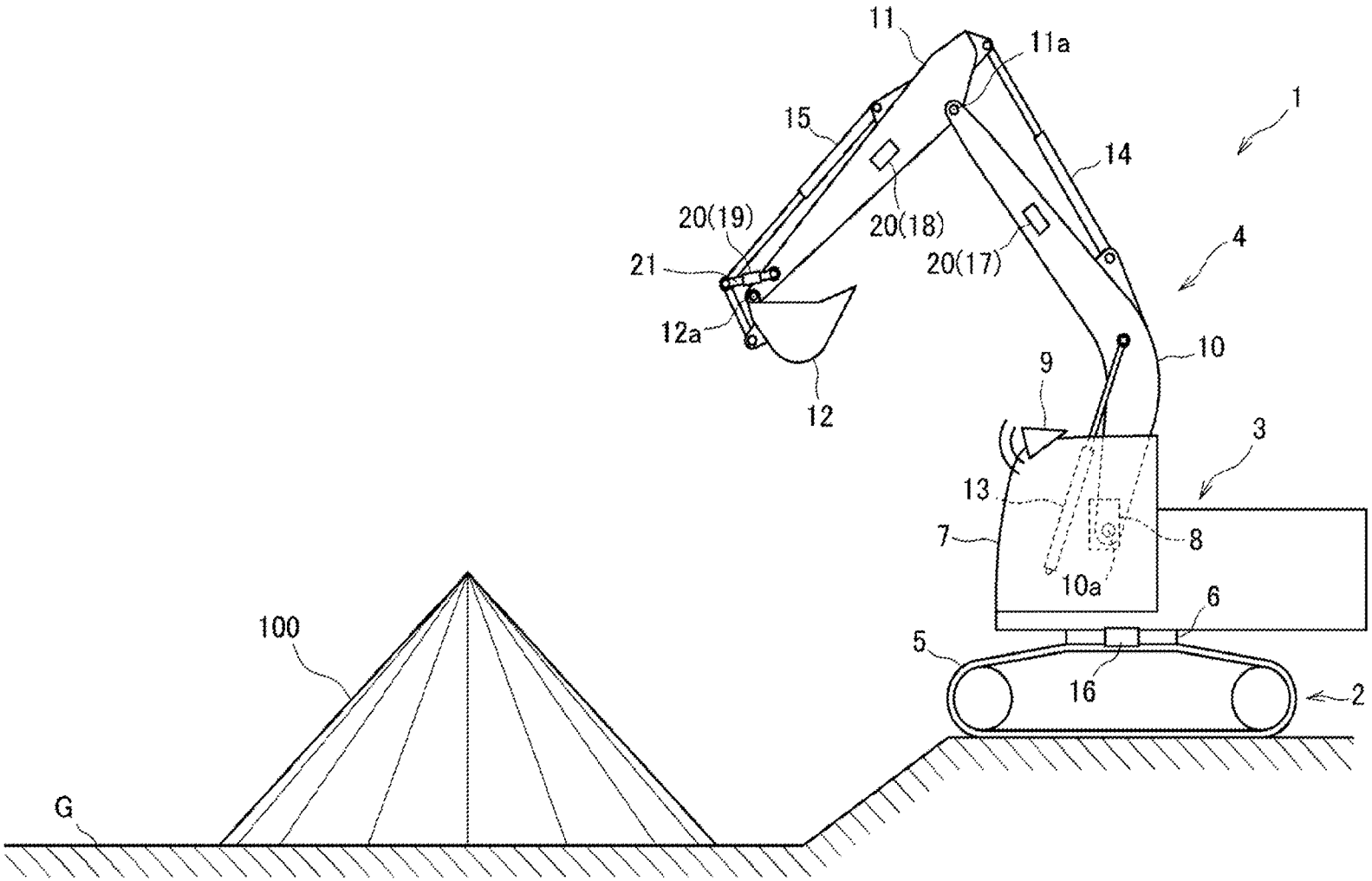
FIG. 1 is a side view of a hydraulic excavator which is a working machine and a pile of soil which is an operation target.

As shown in FIG. 1, the hydraulic excavator 1 is a machine which performs operations by using an attachment 4. The hydraulic excavator 1 includes a lower running body 2, an upper turning body 3, the attachment 4, a turning angular sensor 16, and a tilt angle sensor 20.

The lower running body 2 is a part with which the hydraulic excavator 1 runs, and includes a crawler 5. The upper turning body 3 is rotatably attached to the lower running body 2 through a turning device 6 so that the upper turning body 3 is provided above the lower running body 2. The upper turning body 3 includes a cab 7. The cab 7 is a driver's cabin provided at a front portion of the upper turning body 3.

The attachment 4 is attached to the upper turning body 3 to be rotatable in the up-down direction. The attachment 4 includes a boom 10, an arm 11, and a bucket 12. The base end portion of the boom 10 is attached to the upper turning body 3. The base end portion of the arm 11 is attached to the leading end portion of the boom 10. The bucket 12 is attached to the leading end portion of the arm 11. The bucket 12 is provided at the leading end portion of the attachment 4 to perform operations such as excavation, smoothing, and scooping of an operation target such as a pile of soil 100.

The boom 10, the arm 11, and the bucket 12 are driven by a boom cylinder 13, an arm cylinder 14, and a bucket cylinder respectively. Each of the boom cylinder 13, the arm cylinder 14, and the bucket cylinder 15 is a hydraulic actuator. For example, the boom cylinder 13 moves up and down the boom 10 as the boom cylinder 13 is extended and contracted.

The turning angular sensor 16 is configured to detect a turning angle of the upper turning body 3 relative to the lower running body 2. The turning angular sensor 16 is, for example, an encoder, a resolver, or a gyro sensor.

The tilt angle sensor 20 is configured to detect the posture of the attachment 4. The tilt angle sensor 20 includes a boom tilt angle sensor 17, an arm tilt angle sensor 18, and a bucket tilt angle sensor 19.

The boom tilt angle sensor 17 is configured to detect the posture of the boom 10. For example, the boom tilt angle sensor 17 is a sensor configured to obtain a tilt angle of the boom 10 relative to the horizontal line. For example, the boom tilt angle sensor 17 is attached to the boom 10. The boom tilt angle sensor 17 is, for example, a tilt sensor or an acceleration sensor. The boom tilt angle sensor 17 may detect the posture of the boom 10 by detecting the rotational angle of a boom foot pin 10*a* (boom base end portion). The boom tilt angle sensor 17 may detect the posture of the boom 10 by detecting the stroke amount of the boom cylinder 13.

The arm tilt angle sensor 18 is configured to detect the posture of the arm 11. For example, the arm tilt angle sensor 18 is a sensor configured to obtain a tilt angle of the arm 11 relative to the horizontal line. For example, the arm tilt angle sensor 18 is attached to the arm 11. The arm tilt angle sensor 18 is, for example, a tilt sensor or an acceleration sensor. The arm tilt angle sensor 18 may detect the posture of the arm 11 by detecting the rotational angle of an arm connection pin 11*a* (arm base end portion). The arm tilt angle sensor 18 may detect the posture of the arm 11 by detecting the stroke amount of the arm cylinder 14.

The bucket tilt angle sensor 19 is configured to detect the posture of the bucket 12. For example, the bucket tilt angle sensor 19 is a sensor configured to obtain a tilt angle of the bucket 12 relative to the horizontal line. For example, the bucket tilt angle sensor 19 is attached to a link component 21 by which the bucket 12 is driven. The bucket tilt angle sensor 19 is, for example, a tilt sensor or an acceleration sensor. The bucket tilt angle sensor 19 may detect the posture of the bucket 12 by detecting the rotational angle of an bucket connection pin 12*a* (bucket base end portion). The bucket tilt angle sensor 19 may detect the posture of the bucket 12 by detecting the stroke amount of the bucket cylinder 15.

(Working Area Setting System and Operation Target Detection System)

The hydraulic excavator 1 includes an operation target detection system. The operation target detection system includes a three-dimensional measurement device 9 and a controller 8.

The three-dimensional measurement device 9 is an imaging device configured to obtain data of a pile of soil 100 (operation target) and data of the surroundings of the pile of soil 100. In the present embodiment, the three-dimensional measurement device 9 is attached to the hydraulic excavator 1. The three-dimensional measurement device 9, however, may not be attached to the hydraulic excavator 1. The three-dimensional measurement device 9 is provided at a position where an image of an operation target can be taken, e.g., a position in the vicinity of a location where the operation target is stacked.

The three-dimensional measurement device 9 is, for example, a LIDAR (Light Detection and Ranging), a laser radar, a millimeter wave radar, or a stereo camera. The three-dimensional measurement device 9 may be, for example, a combination of a LIDAR and a camera.

Figure 2:
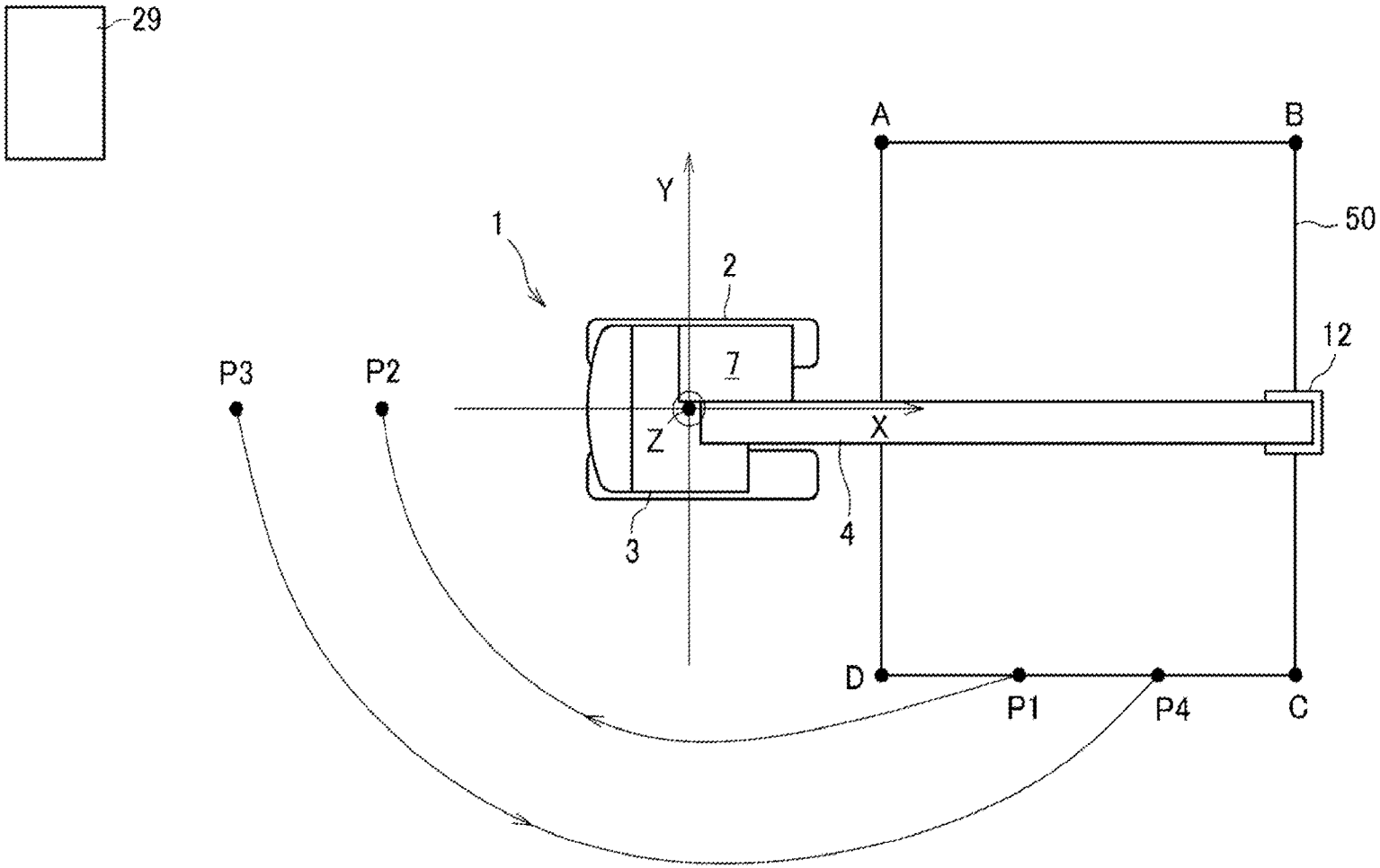
FIG. 2 is a plan view for explaining, for example, a process of setting a working area.

A portable terminal 29 shown in FIG. 2 is a terminal operated by an operator at a workplace. An example of the portable terminal 29 is a tablet terminal. The portable terminal 29 is able to mutually communicate with the hydraulic excavator 1.

Figure 4:
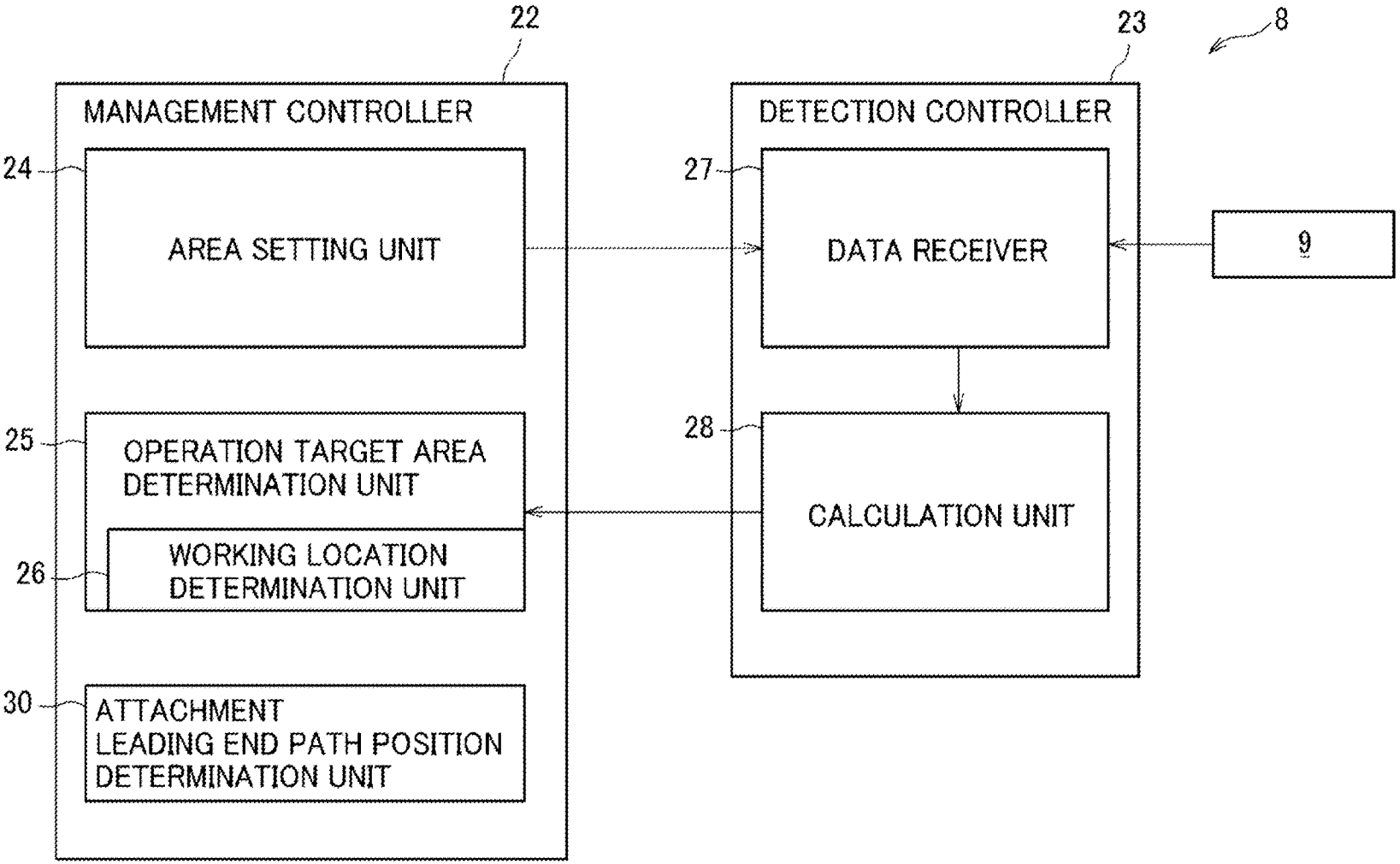
FIG. 4 is a block diagram of controllers mounted on a hydraulic excavator constituting an operation target detection system.

The controller 8 may be provided outside the hydraulic excavator 1, or may be mounted on the hydraulic excavator 1 as shown in FIG. 4. The controller 8 includes a management controller 22 and a detection controller 23.

The management controller 22 includes an area setting unit 24, an operation target area determination unit 25, and an attachment leading end path position determination unit 30. The detection controller 23 includes a data receiver 27 and a calculation unit 28.

Figure 3:
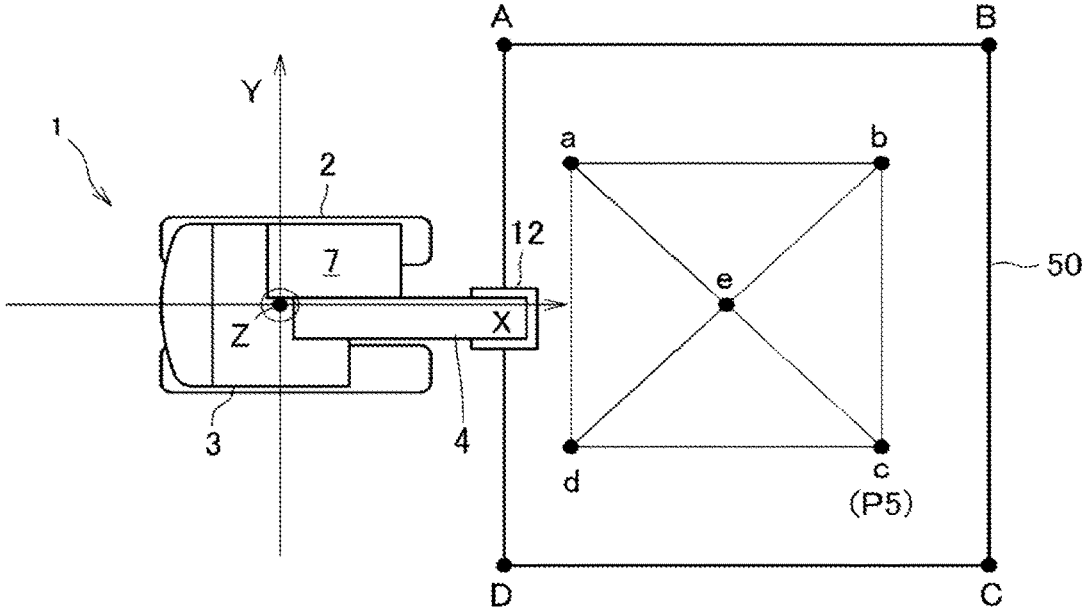
FIG. 3 is a plan view in which three-dimensional information regarding the position, range, and shape of a pile of soil is added to the working area shown in FIG. 2.

The area setting unit 24 is provided for setting (determining) a working area 50 (see FIG. 2 and FIG. 3). The working area 50 is, for example, a predetermined range in which a pile of soil 100 is formed by the hydraulic excavator 1. The area setting unit 24 constitutes the working area setting system. The area setting unit 24, the three-dimensional measurement device 9, and the calculation unit 28 constitute the operation target detection system.

The operation target area determination unit 25 is provided to determine an area that includes an operation target. For example, the operation target area determination unit 25 determines a range of a pile of soil (described later) calculated by the calculation unit 28.

Figures such as FIG. 2 and FIG. 3 show a three-dimensional coordinate system using the hydraulic excavator 1 as the origin. A direction from the hydraulic excavator 1 to the working area 50 is an X-axis direction (X-axis). A Y-axis extends in a direction perpendicular to the X-axis in a horizontal plane. A Z-axis is perpendicular to both the X-axis and the Y-axis. The Z-axis extends in a vertical direction. A Z-axis direction is a vertically upward direction.

With reference to figures such as FIG. 2 and FIG. 4, the following will describe a process of setting the working area 50 shown in FIG. 2. An operator (e.g., an operator of the hydraulic excavator 1) performs teaching of the working area 50 in the following manner, for example.

The operator of the hydraulic excavator 1 sets points A and C for specifying the border between the working area 50 and the outside of the area. To be more specific, the operator of the hydraulic excavator 1 places the leading end of the attachment 4 (the claw leading end of the bucket 12, e.g., a central portion in the width direction of the claw leading end of the bucket 12) at the point A and the point C on the ground G. For example, the operator of the hydraulic excavator 1 specifies the points in accordance with an instruction from the portable terminal 29. (This is applicable to a later-described teaching different from the teaching of the points A and C, too.)

The area setting unit 24 (see FIG. 4) calculates the coordinates of each of the points A and C shown in FIG. 2 based on signals from the turning angular sensor 16 and the tilt angle sensor 20 (the boom tilt angle sensor 17, the arm tilt angle sensor 18, and the bucket tilt angle sensor 19) shown in FIG. 1. Coordinates of points are calculated based on such signals also in the later-described teaching that is different from the teaching of the points A and C. A specific example of the teaching is as follows. By operating the attachment 4, the operator moves the leading end of the attachment 4 (the claw leading end of the bucket 12) to a position that is to be set as the point A. The operator then presses, for example, a confirmation button of the portable terminal 29. The area setting unit 24 (see FIG. 4) calculates the coordinates of the leading end of the attachment 4 when, for example, the confirmation button is pressed, and sets the calculated coordinates as the coordinates of the point A. The teaching and calculation are performed in a similar manner for the point C. Alternatively, the calculation of the coordinates of the points A and C may be done by a unit different from the area setting unit 24, and a result of the calculation may be sent to the area setting unit 24.

The coordinates of the remaining two points B and D used for specifying the working area 50 are determined based on the coordinates of the point A and the point C. The area setting unit 24 (see FIG. 4) determines the points B and D based on the points A and C. After the coordinates of all points A to D are determined, the area setting unit 24 sets (determines) and stores the working area 50.

The point A is a point (first position) close to the hydraulic excavator 1 among the two positions where the leading end of the attachment 4 (claw leading end of the bucket 12) is placed. The point C is a point (second position) far from the hydraulic excavator 1 among the two positions where the leading end of the attachment 4 (the claw leading end of the bucket 12) is placed. The points A and C are positions diagonal to each other in the rectangular working area 50 in plan view. For example, the front-rear direction of the upper turning body 3 when the upper turning body 3 is disposed to face the middle point between the points A and C is assumed to be a direction in which two sides (opposing two sides, i.e., line segments AB and DC) of the rectangular working area 50 extend in plan view. In addition to this, the width direction of the upper turning body 3 in this case is assumed to be a direction in which the remaining two sides (i.e., line segments AD and BC) of the rectangular working area 50 extend in plan view.

Assume that the two-dimensional coordinates of the point A are A (XA, YA) and the two-dimensional coordinates of the point C are C (XC, YC). With reference to the two-dimensional coordinates of the points A and C, the two-dimensional coordinates of the points B and D are B (XC, YA) and D (XA, YC), respectively.

The area setting unit 24 (see FIG. 4) stores positions (the points A and C) where the leading end of the attachment 4 (the claw leading end of the bucket 12) is placed, as points for specifying the border between the working area 50 and the outside of this area. Furthermore, the area setting unit 24 stores positions (the points B and D) determined based on the points A and C, as points for specifying the border between the working area 50 and the outside of this area. When the working area 50 is set, the points for specifying the working area 50 are determined an actual operation by the operator. The operator is therefore able to grasp the working area 50.

The area setting unit 24 shown in FIG. 4 sends the coordinates data of the point A (see FIG. 2) and the point C (see FIG. 2) to the data receiver 27 of the detection controller 23. The data receiver 27 transfers the coordinates data of the points A and C to the calculation unit 28.

In the example above, the leading end of the attachment 4 (the claw leading end of the bucket 12) shown in FIG. 2 is placed on the two points on the ground G, i.e., the points A and C, and the coordinates of the points A, B, C, and D are figured out. Alternatively, the working area 50 may be set (determined) in such a way that the leading end of the attachment 4 (the claw leading end of the bucket 12) is placed on all of the points A, B, C, and D on the ground G. It is noted that the area setting unit 24 shown in FIG. 4 may not be provided in the management controller 22. The calculation of the coordinates of the points A to D (see FIG. 2) may be done by a member different from the management controller 22 (see FIG. 2), and a result of the calculation may be sent to the management controller 22 (see FIG. 2).

The number of operations of the hydraulic excavator 1 is small when the remaining two points B and D are determined based on the first position close to the hydraulic excavator 1 and the second position far from the hydraulic excavator 1, which are the two positions where the leading end of the attachment 4 (the claw leading end of the bucket 12) is placed.

The operator (e.g., an operator of the hydraulic excavator 1) performs teaching of the target path of the leading end of the attachment 4 in the following manner, for example.

The operator of the hydraulic excavator 1 specifies a lifting turn start point P1. The lifting turn start point P1 is a position (start point) of the leading end of the attachment 4 (the claw leading end of the bucket 12) when the bucket 12 having scooped and lifted soil leaves the working area 50. The point P1 is a point where the leading end of the attachment 4 passes through.

As shown in FIG. 2, in plan view, the lifting turn start point P1 is on the line segment CD by which the working area is specified, for example. The lifting turn start point P1 is above the ground G. For example, when the line segment CD is set on the ground G, the lifting turn start point P1 is positioned above the line segment CD. In plan view, the lifting turn start point P1 is above the border between the working area 50 and the outside of this area.

The attachment leading end path position determination unit (see FIG. 4) sets the lifting turn start point P1 as a passing point where the leading end of the attachment 4 (the claw leading end of the bucket 12) passes when the leading end moves from the inside to the outside of the working area 50.

The operator of the hydraulic excavator 1 performs teaching of a path from the lifting turn start point P1 to a lifting turn end point P2 (described later). When the attachment 4 moves from the lifting turn start point P1 to the lifting turn end point P2, the controller 8 always continuously records signal data (angle data) of the turning angular sensor 16 and the tilt angle sensor 20 (the boom tilt angle sensor 17, the arm tilt angle sensor 18, and the bucket tilt angle sensor 19) shown in FIG. 1. The continuous recording of the signal data occurs also in the teaching of a path from a returning turn start point P3 to a returning turn end point P4.

The operator of the hydraulic excavator 1 specifies the lifting turn end point P2 shown in FIG. 2. The lifting turn end point P2 is a position (point) of the leading end of the attachment 4 when the bucket 12 having soil therein reaches a position above a place where soil is discharged. The lifting turn end point P2 is a point where the leading end of the attachment 4 (the claw leading end of the bucket 12) passes through. The place where soil is discharged is, for example, a cargo bed of a conveyance vehicle for conveying soil.

The operator of the hydraulic excavator 1 specifies the returning turn start point P3 shown in FIG. 2. The returning turn start point P3 is a position (start point) of the leading end of the attachment 4 (the claw leading end of the bucket 12) when the bucket 12 having discharged the soil leaves the place where the soil was discharged. The point P3 is a point where the leading end of the attachment 4 passes through.

The operator of the hydraulic excavator 1 performs teaching of a path from the returning turn start point P3 to a returning turn end point P4 (described later).

The operator of the hydraulic excavator 1 specifies the returning turn end point P4. The returning turn end point P4 is a position (point) of the leading end of the attachment 4 (the claw leading end of the bucket 12) when the bucket 12 having discharged the soil reaches the working area 50. The point P4 is a point where the leading end of the attachment 4 passes through.

The returning turn end point P4 is, for example, on the line segment CD by which the working area 50 is specified, in plan view. The returning turn end point P4 is above the ground G. For example, when the line segment CD is set on the ground G, the returning turn end point P4 is positioned above the line segment CD. In plan view, the returning turn end point P4 is above the border between the working area and the outside of this area.

The attachment leading end path position determination unit (see FIG. 4) sets the returning turn end point P4 as a passing point where the leading end of the attachment 4 (the claw leading end of the bucket 12) passes when the leading end moves from the outside to the inside of the working area 50.

The attachment leading end path position determination unit 30 (see FIG. 4) may set only one of the lifting turn start point P1 and the returning turn end point P4 as the passing point.

Figure 5:
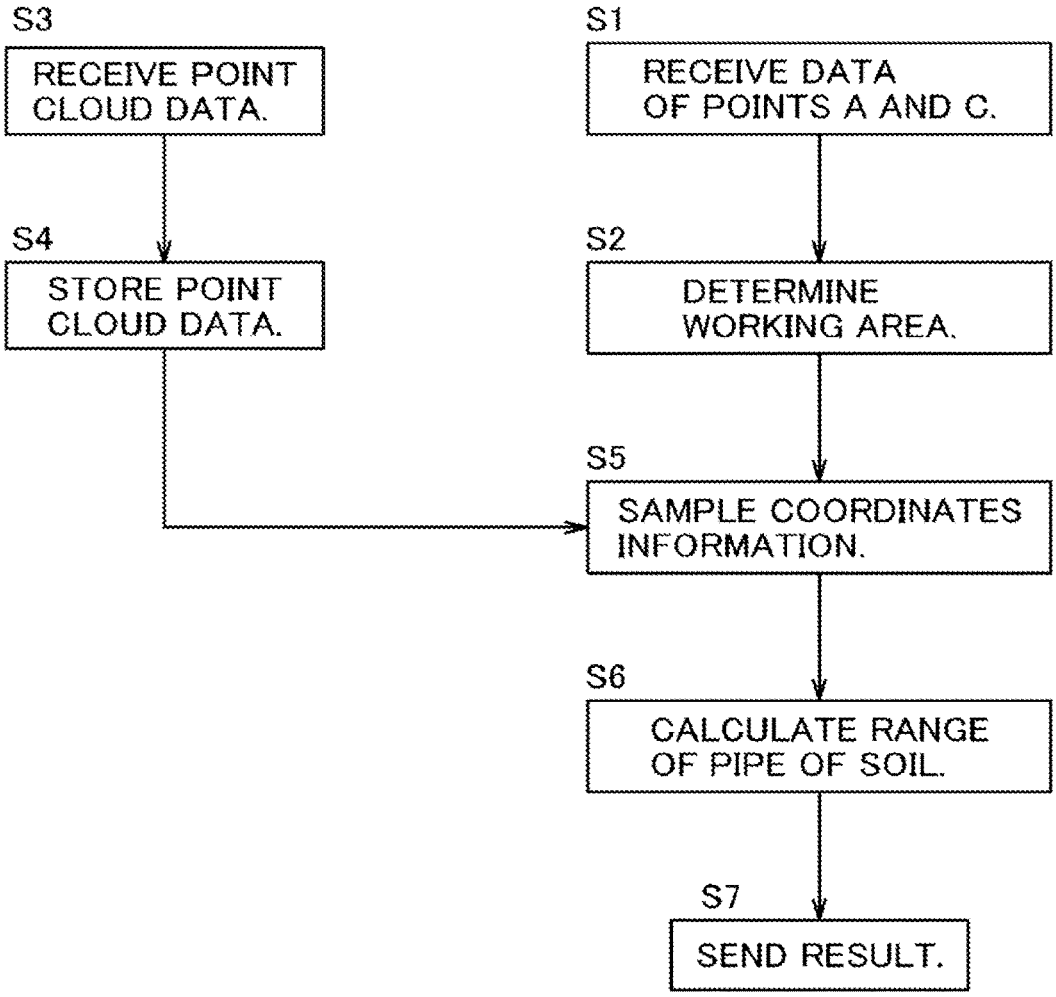
FIG. 5 is a flowchart of a process performed by the detection controller shown in FIG. 4.

The following will describe detection of a pile of soil 100 (see FIG. 1) with reference to FIG. 3 to FIG. 5.

The data receiver 27 (see FIG. 4) receives the coordinates data of the points A and C shown in FIG. 3 from the area setting unit 24 (see FIG. 4). (This is the step 1 and indicated as S1 in FIG. 5. It is noted that the other steps will be similarly indicated.) In the descriptions below, each step indicated in FIG. 5 will be explained with reference to FIG. 5. The calculation unit 28 (see FIG. 4) determines the working area 50 specified by the points A to D, based on the coordinates data of the points A and C shown in FIG. 3 (S2).

On the other hand, the three-dimensional measurement device 9 (see FIG. 1) obtains point cloud data of the pile of soil 100 (see FIG. 1) and its surroundings. The data receiver 27 (see FIG. 4) receives the point cloud data obtained by the three-dimensional measurement device 9 (see FIG. 1) (S3). The data receiver 27 stores the received point cloud data (S4). The calculation unit 28 (see FIG. 4) samples the stored point cloud data and the coordinates data of the points A and C from the data receiver 27 (S5).

The calculation unit 28 (see FIG. 4) calculates the three-dimensional information regarding the position, range, and shape of the pile of soil 100 (see FIG. 1) in the working area 50, based on the point cloud data (measurement data obtained by the three-dimensional measurement device 9 (see FIG. 1)) (S6). To be more specific, for example, the calculation unit 28 calculates three-dimensional information of the range of the pile of soil so that the point cloud data of the pile of soil 100 is included.

To be more specific, for example, the actual shape of the pile of soil 100 shown in FIG. 1 as an example is conical. As shown in FIG. 3, the calculation unit 28 (see FIG. 4) calculates the three-dimensional information of the range of the pile of soil so that the conical pile of soil 100 is included. To be further specific, the shape of the range of the pile of soil in the three-dimensional information, which is specified by the points a, b, c, d, and e shown in FIG. 3, is quadrangular pyramid. The three-dimensional information includes the three-dimensional coordinates of the points a, b, c, d, and e. The points a, b, c, and d specify the area including the bottom of the pile of soil 100 (see FIG. 1), and the point e specifies the apex of the pile of soil 100. The three-dimensional information regarding the position, range, and shape of the pile of soil 100 is not limited to the range of the pile of soil, which is quadrangular pyramid in shape. The calculation unit 28 (see FIG. 4) may calculate the range of the pile of soil, which is, for example, octagonal pyramid in shape so that the conical pile of soil 100 is included.

The calculation unit 28 (see FIG. 4) sends the calculated three-dimensional information regarding the position, range, and shape of the pile of soil 100 (see FIG. 1) to the operation target area determination unit 25 (see FIG. 4) of the management controller 22 (see FIG. 4) (S7). With this, the detection of the pile of soil 100 (see FIG. 1) is completed.

The calculation of the three-dimensional information regarding the position, range, and shape of the pile of soil 100 (see FIG. 1) is performed each time the attachment 4 (bucket 12) excavates the pile of soil 100 (see FIG. 1). The calculation of the three-dimensional information is performed also when the operation at the pile of soil 100 is completed and then an operation at another pile of soil 100 is performed.

When the working area 50 that is a predetermined range in which the pile of soil 100 (see FIG. 1) that is a target of operation by the hydraulic excavator 1 is formed is set by the area setting unit 24 (see FIG. 4), it is easy in, for example, automatic driving control of the hydraulic excavator 1 to specify the pile of soil 100 which is the target of excavation. Because the pile of soil 100 can be easily specified, the calculation unit 28 (see FIG. 4) can easily perform the calculation. It is therefore easy to perform the automatic driving control of the hydraulic excavator 1. Furthermore, it is possible to prevent erroneous detection when, for example, there is another pile of soil outside the working area 50 (as described later).

P5 in FIG. 3 indicates an excavation start point (operation start point). The excavation start point P5 is a point where the excavation by the attachment 4 (bucket 12) starts. The operation target area determination unit 25 (see FIG. 4) includes a working location determination unit 26 (see FIG. 4). The working location determination unit 26 determines the excavation start point P5 of the operation target based on the three-dimensional information calculated by the calculation unit 28 (see FIG. 4). This arrangement makes it possible to automatically determine a suitable excavating position when the hydraulic excavator 1 is automatically driven. In FIG. 3, the excavation start point P5 is at the point c in plan view.

The attachment 4 (bucket 12) is moved from the returning turn start point P3 to the returning turn end point P4 shown in FIG. 2, and is then moved from the returning turn end point P4 to the excavation start point P5 (see FIG. 3).

The excavation start point P5 (see FIG. 3) is changed in accordance with the excavation state of the pile of soil 100 (see FIG. 1). On the other hand, the path of the attachment 4 (bucket 12) from the returning turn start point P3 to the returning turn end point P4 is not changed in accordance with the excavation state of the pile of soil 100. It is therefore unnecessary to correct the path of the attachment 4 (bucket 12) from the returning turn start point P3 to the returning turn end point P4 in accordance with a change of the excavation state of the pile of soil 100.

In the present embodiment, the working area 50 that is a predetermined range in which the pile of soil 100 (see FIG. 1) is formed is set. On this account, it is possible to distinguish the path of the attachment 4 (bucket 12) from the returning turn start point P3 to the returning turn end point P4 from the path of the attachment 4 (bucket 12) from the returning turn end point P4 to the excavation start point P5 (see FIG. 3), i.e., it is possible to distinguish regions. It is therefore unnecessary to correct the path of the attachment 4 (bucket 12) from the returning turn start point P3 to the returning turn end point P4 when the state of the pile of soil 100 (see FIG. 1) is changed due to, for example, excavation. The automatic driving control of the hydraulic excavator 1 can be easily done for this reason.

The effects described above are further reliably achieved thanks to the existence of the attachment leading end path position determination unit 30 (see FIG. 4). The attachment leading end path position determination unit 30 may determine the passing point where the leading end of the attachment 4 of the hydraulic excavator 1 passes when the leading end moves from the outside to the inside of the working area 50. The attachment leading end path position determination unit 30 may determine the passing point where the leading end of the attachment 4 of the hydraulic excavator 1 passes when the leading end moves from the inside to the outside of the working area 50.

In addition to the above, the passing point (e.g., at least one of the lifting turn start point P1 or the returning turn end point P4) is provided on the border between the working area 50 and the outside of this area in plan view. As a result, the paths of the attachment 4 (bucket 12) are clearly distinguished from each other and hence the operator is able to perform operations without worry.

The path region between the lifting turn start point P1 and the lifting turn end point P2 is a region where a teaching instruction is prioritized. Because the path of the attachment 4 is provided in the region where the teaching instruction is prioritized and the operator is able to easily grasp the path, the safety of the operator is ensured. The path region between the returning turn start point P3 and the returning turn end point P4 is a region where a teaching instruction is prioritized. Because the path of the attachment 4 is provided in the region where the teaching instruction is prioritized and the operator is able to easily grasp the path, the safety of the operator is ensured.

Figure 6:
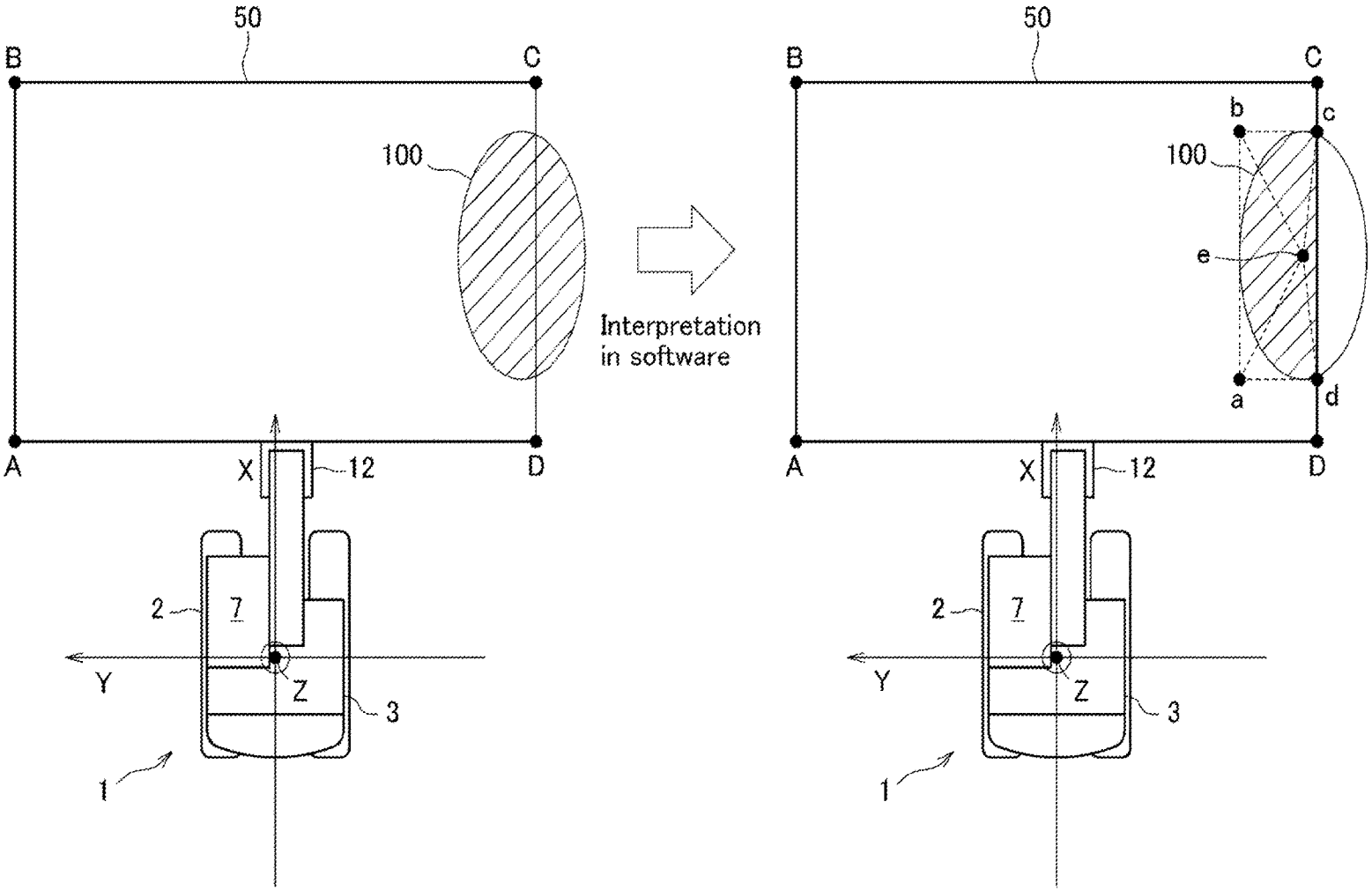
FIG. 6 is a plan view for explaining a process of calculating three-dimensional information regarding the position, range, and shape of a pile of soil when the pile of soil spreads across a working area and the outside of the working area.
Figure 7:
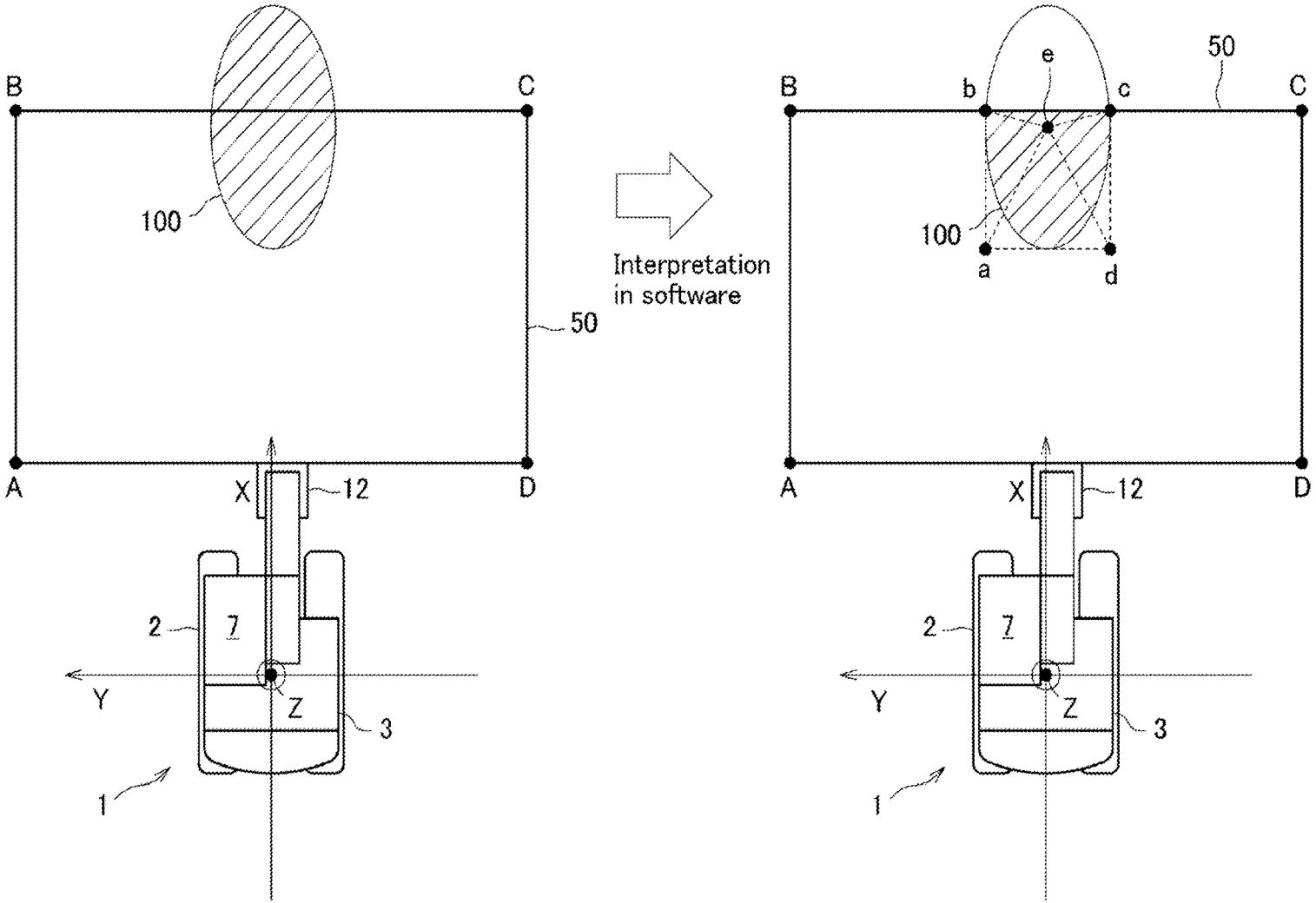
FIG. 7 is a plan view for explaining a process of calculating three-dimensional information regarding the position, range, and shape of a pile of soil when the pile of soil spreads across the outside of a working area and the working area.

Each of FIG. 6 and FIG. 7 is a plan view for explaining a process of calculating three-dimensional information regarding the position, range, and shape of a pile of soil 100 when the pile of soil 100 spreads across the outside of a working area 50 and the working area 50.

When the pile of soil 100 spreads across the outside of the working area 50 and the working area 50, the calculation unit 28 (see FIG. 4) calculates three-dimensional information of the position, range, and shape of only a part of the pile of soil 100, which exists inside the working area 50.

With this arrangement, when the pile of soil 100 spreads across the outside of a working area 50 and the working area only the inside of the working area 50 is set as a target of processing by the calculation unit 28 (see FIG. 4).

In FIG. 6, the pile of soil 100 spreads over the line segment CD connecting the points C and D by which the working area is specified. In this case, when calculating the three-dimensional information of the position, range, and shape of the pile of soil 100, the calculation unit 28 (see FIG. 4) does not use the point cloud data of a part of the pile of soil 100, which is outside the working area 50. The calculation unit 28 calculates the three-dimensional information of the position, range, and shape of the pile of soil 100 by using only the point cloud data of the inside of the working area 50. As shown in FIG. 6, among the calculated points a, b, c, d, and e, in plan view, the points c and d are on the line segment CD by which the working area is specified.

In FIG. 7, the pile of soil 100 spreads over the line segment BC connecting the points B and C by which the working area is specified. In this case, when calculating the three-dimensional information of the position, range, and shape of the pile of soil 100, the calculation unit 28 (see FIG. 4) calculates the three-dimensional information of the position, range, and shape of the pile of soil 100 by using only the point cloud data of the inside of the working area 50. As shown in FIG. 7, among the calculated points a, b, c, d, and e, in plan view, the points b and c are on the line segment BC by which the working area 50 is specified.

(Effects of First Aspect of Invention)

[Arrangement 1] The working area setting system of the present embodiment includes the area setting unit 24 (see FIG. 4). The area setting unit 24 is provided for setting the working area 50 (see FIG. 3). The working area 50 is a predetermined range where the pile of soil 100 (operation target) that is a target of operation of the hydraulic excavator 1 (working machine) shown in FIG. 1 is stacked.

According to the [Arrangement 1], the area setting unit 24 (see FIG. 4) sets the working area 50 shown in FIG. 3. On this account, a pile of soil 100 that is a target of excavation can be easily specified in, for example, the automatic driving control of the hydraulic excavator 1. Because a pile of soil 100 can be easily specified, for example, the calculation unit 28 (see FIG. 4) can easily perform the calculation. The automatic driving control of the hydraulic excavator 1 can be easily done for this reason. Furthermore, it is possible to prevent erroneous detection when, for example, there is another pile of soil outside the working area 50.

(Effects of Second Aspect of Invention)

[Arrangement 2] The area setting unit 24 (see FIG. 4) stores positions (e.g., the points A and C) where the leading end of the attachment 4 of the hydraulic excavator 1 (the claw leading end of the bucket 12) is placed, as points for specifying the border between the working area 50 and the outside of this area.

With this [Arrangement 2], when the working area 50 is set, the points for specifying the working area 50 are determined by an actual operation by the operator. The operator is therefore able to grasp the working area 50.

(Effects of Third Aspect of Invention)

[Arrangement 3] The working area 50 is rectangular in plan view.

With this [Arrangement 3], the load of the calculation regarding the working area 50 is light as compared to cases where the working area 50 is not rectangular but is complicated in shape in plan view (e.g., not rectangular but polygonal, circular, or elliptic).

(Effects of Fourth Aspect of Invention)

[Arrangement 4] Based on the first position (e.g., the point A) and the second position (e.g., the point C) where the leading end of the attachment 4 is placed, the remaining two points (B and C) are determined. Among the two positions (e.g., the points A and C) where the leading end of the attachment 4 is placed, the position close to the hydraulic excavator 1 is the first position (e.g., the point A) whereas the position far from the hydraulic excavator 1 is the second position (point C). The remaining two points (e.g., the points B and D) are two points different from the first position (point A) and the second position (point B) among the four points by which the border between the working area 50 and the outside of this area is specified in the [Arrangement 2].

According to the [Arrangement 4], when the remaining two points (points B and D) are determined, it is unnecessary to place the leading end of the attachment 4 at the points B and D. The number of operations of the hydraulic excavator 1 is therefore advantageously reduced.

(Effects of Fifth Aspect of Invention)

[Arrangement 5] The working area setting system includes the attachment leading end path position determination unit 30 (see FIG. 4). The attachment leading end path position determination unit 30 determines the passing point (e.g., the lifting turn start point P1 and/or the returning turn end point P4 shown in FIG. 2). The passing point is a point where the leading end of the attachment 4 of the hydraulic excavator 1 passes when the leading end moves from the outside to the inside of the working area 50 and/or when the leading end moves from the inside to the outside of the working area 50.

With the above-described [Arrangement 5], it is possible to distinguish the path of the attachment 4 (bucket 12) outside the working area 50 shown in FIG. 2 from the path of the attachment 4 (bucket 12) inside the working area 50. In other words, it is possible to distinguish these regions. It is therefore unnecessary to correct the path of the attachment 4 (bucket 12) outside the working area 50 (e.g., from the returning turn start point P3 to the returning turn end point P4) even though the state of the pile of soil 100 (see FIG. 1) is changed due to, for example, excavation. The automatic driving control of the hydraulic excavator 1 can therefore be easily done for this reason.

(Effects of Sixth Aspect of Invention)

[Arrangement 6] The attachment leading end path position determination unit 30 (see FIG. 4) determines the passing point (e.g., the lifting turn start point P1 and/or the returning turn end point P4) on the border between the working area 50 and the outside of this area in plan view.

This [Arrangement 6] clarifies the regions of the paths of the attachment 4 (bucket 12) (see the [Arrangement 5] above). For this reason, the operator is able to perform the operations without worry.

(Effects of Eighth Aspect of Invention)

[Arrangement 8] As shown in FIG. 1, the operation target detection system includes the three-dimensional measurement device 9 and the calculation unit 28 (see FIG. 4). The three-dimensional measurement device 9 obtains the data of the pile of soil 100 and its surroundings. The calculation unit 28 calculates the three-dimensional information regarding the position, range, and shape of the pile of soil 100 in the working area 50 (see FIG. 3), based on the measurement data obtained by the three-dimensional measurement device 9.

According to the [Arrangement 8], the three-dimensional information regarding the position, range, and shape of the pile of soil 100 in the working area 50 (see the [Arrangement 1] above) is calculated. On this account, when there is another pile of soil outside the working area 50 shown in FIG. 3, the calculation unit 28 (see FIG. 4) is not required to calculate the three-dimensional information of this pile of soil. It is therefore possible to lighten the load of calculation on the calculation unit 28.

(Effects of Ninth Aspect of Invention)

[Arrangement 9] As shown in FIG. 6, when the pile of soil 100 spreads across the outside of the working area 50 and the working area 50, the calculation unit 28 (see FIG. 4) calculates three-dimensional information of only a part of the pile of soil 100, which exists inside the working area 50.

With the [Arrangement 9], only the pile of soil 100 inside the working area 50 is set as a target of processing by the calculation unit 28 (see FIG. 4). It is therefore possible to lighten the load of calculation on the calculation unit 28.

[Effects of Tenth Aspect of Invention]

[Arrangement 10] The operation target detection system includes the working location determination unit 26 (see FIG. 4). The working location determination unit 26 determines the excavation start point P5 (operation start point) of the pile of soil 100 based on the three-dimensional information calculated by the calculation unit 28 (see FIG. 4).

This [Arrangement 10] makes it possible to automatically determine a suitable excavating position when the hydraulic excavator 1 is automatically driven.

Second Embodiment

In regard to a working area setting system and an operation target detection system of Second Embodiment, differences from First Embodiment will be described with reference to FIG. 8 to FIG. 13. In regard to the working area setting system and the operation target detection system of Second Embodiment, arrangements identical with those of First Embodiment will not be explained again.

Figure 8:
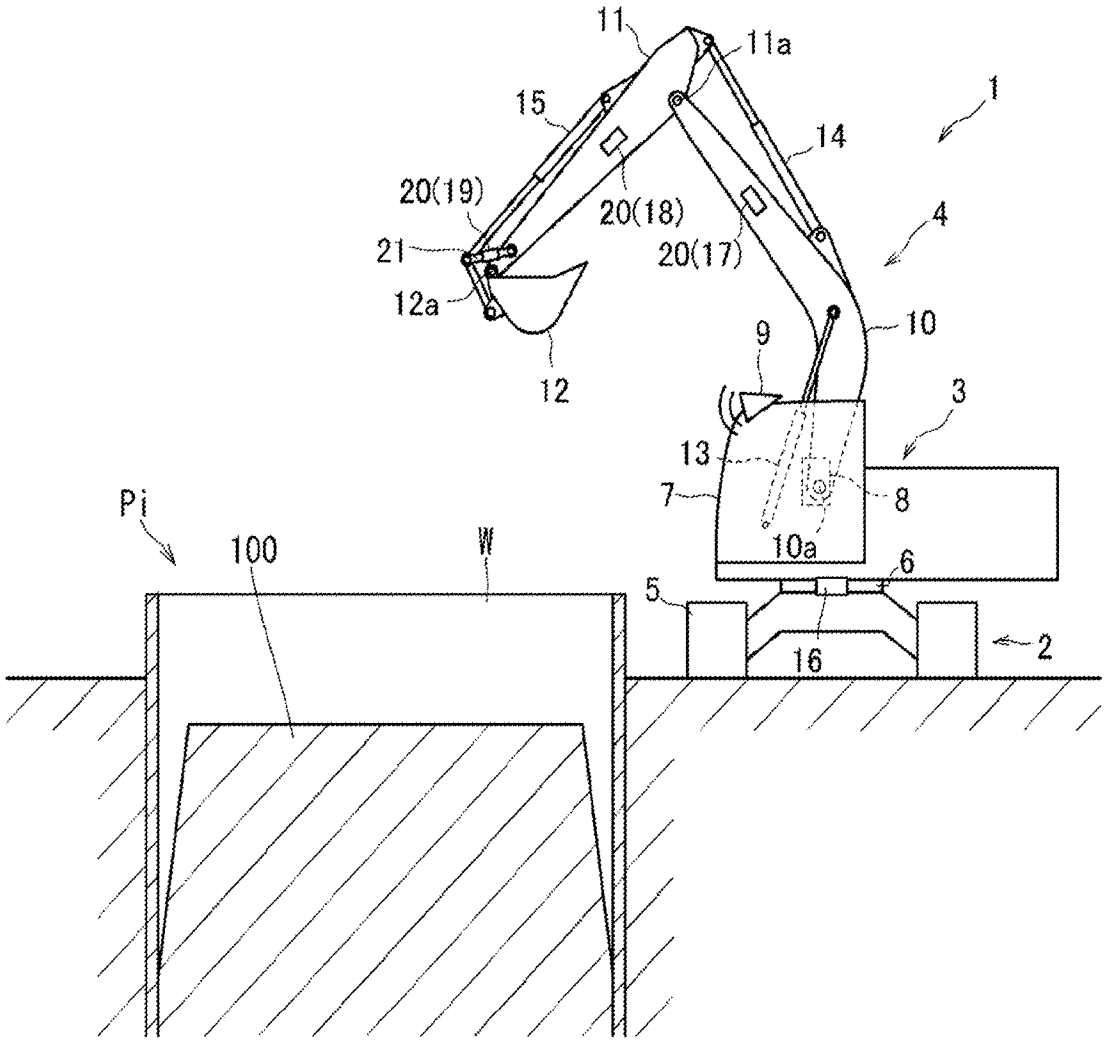
FIG. 8 corresponds to Second Embodiment and is equivalent to FIG. 1.

In the example shown in FIG. 1, the height at which an operation (e.g., excavation) is performed by the attachment 4 is substantially identical with the height of the lower running body 2. In this regard, as shown in FIG. 8, the height at which an operation is performed may be lower than the height of the lower running body 2. For example, the pile of soil 100 may be inside a soil pit Pi or may be surrounded by a wall W of a soil pit Pi.

Figure 10:
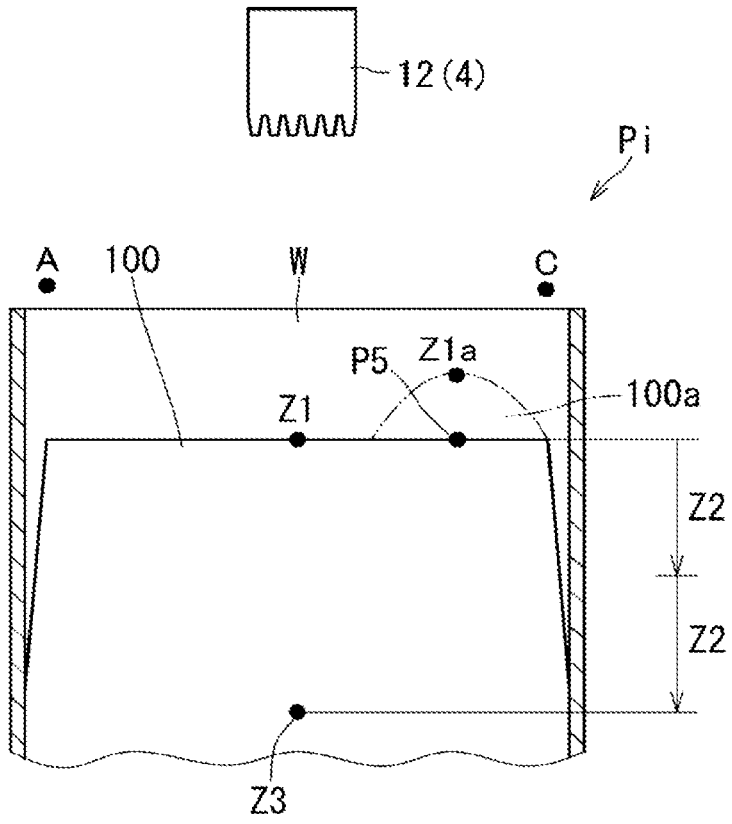
FIG. 10 is an arrow view taken along a line F10-F10 of FIG. 9.

In First Embodiment, the starting point where the operation by the attachment 4 shown in FIG. 3 starts, i.e., the excavation start point P5 is determined by the working location determination unit 26 based on the three-dimensional information calculated by the calculation unit 28 shown in FIG. 4. The position in the height direction of the starting point where the operation by the attachment 4 shown in FIG. 3 starts is determined by the working location determination unit 26 based on the three-dimensional information calculated by the calculation unit 28 shown in FIG. 4. On the other hand, in the present embodiment, an operation initial height Z1 shown in FIG. 10 is determined by teaching. To be more specific, the operation target detection system includes an operation initial height determination unit 240 (see FIG. 11) which is configured to determine the operation initial height Z1 (as described later).

(Settings)

In the operation target detection system, teaching is performed in the following manner. In the same manner as in First Embodiment, the operator of the hydraulic excavator 1 shown in FIG. 9 operates the hydraulic excavator 1 to teach the points A and C (S201 and S202 shown in FIG. 12). The heights of the points A and C may be above the upper end of the wall W as shown in FIG. 10, identical with the height of the upper end of the wall W, or lower than the upper end of the wall W.

Figure 9:
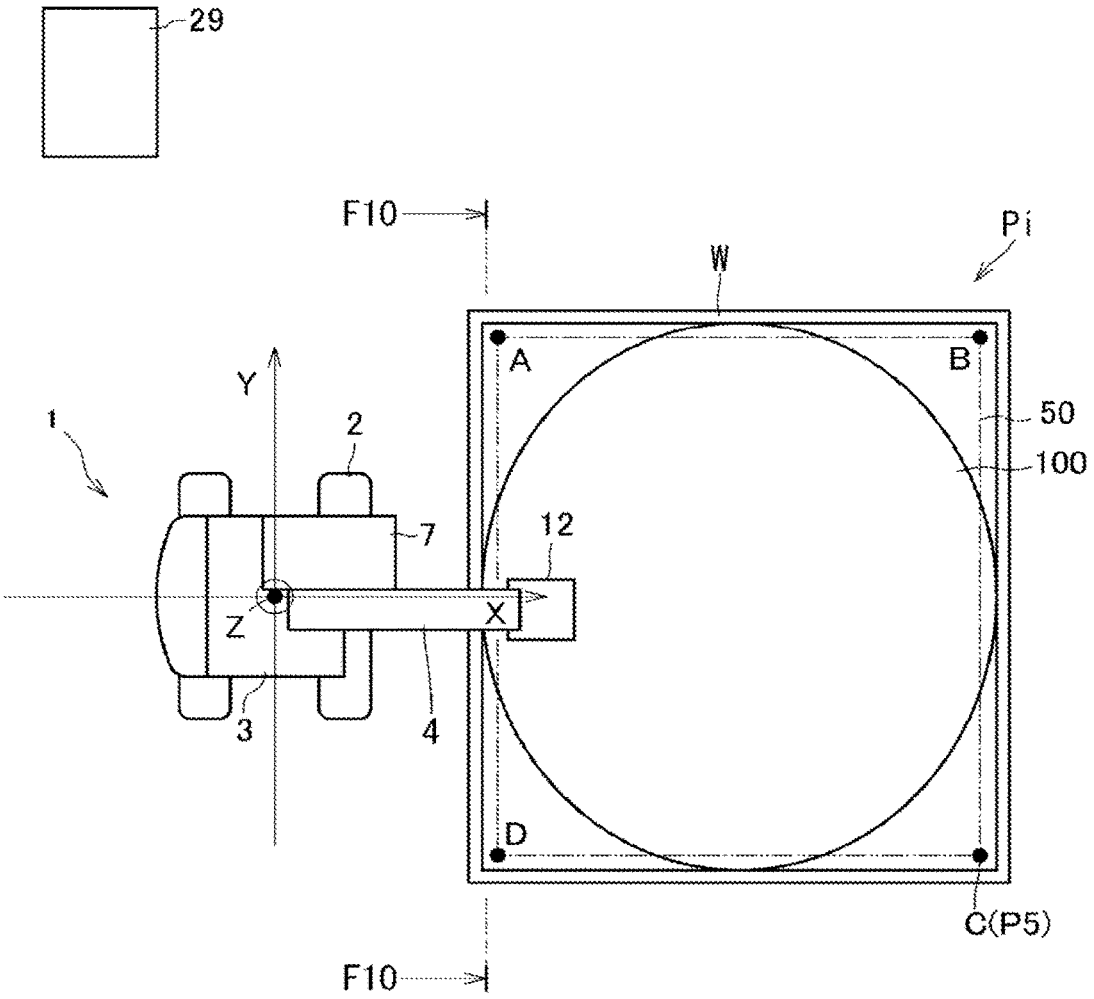
FIG. 9 corresponds to Second Embodiment and is equivalent to FIG. 3.
Figure 11:
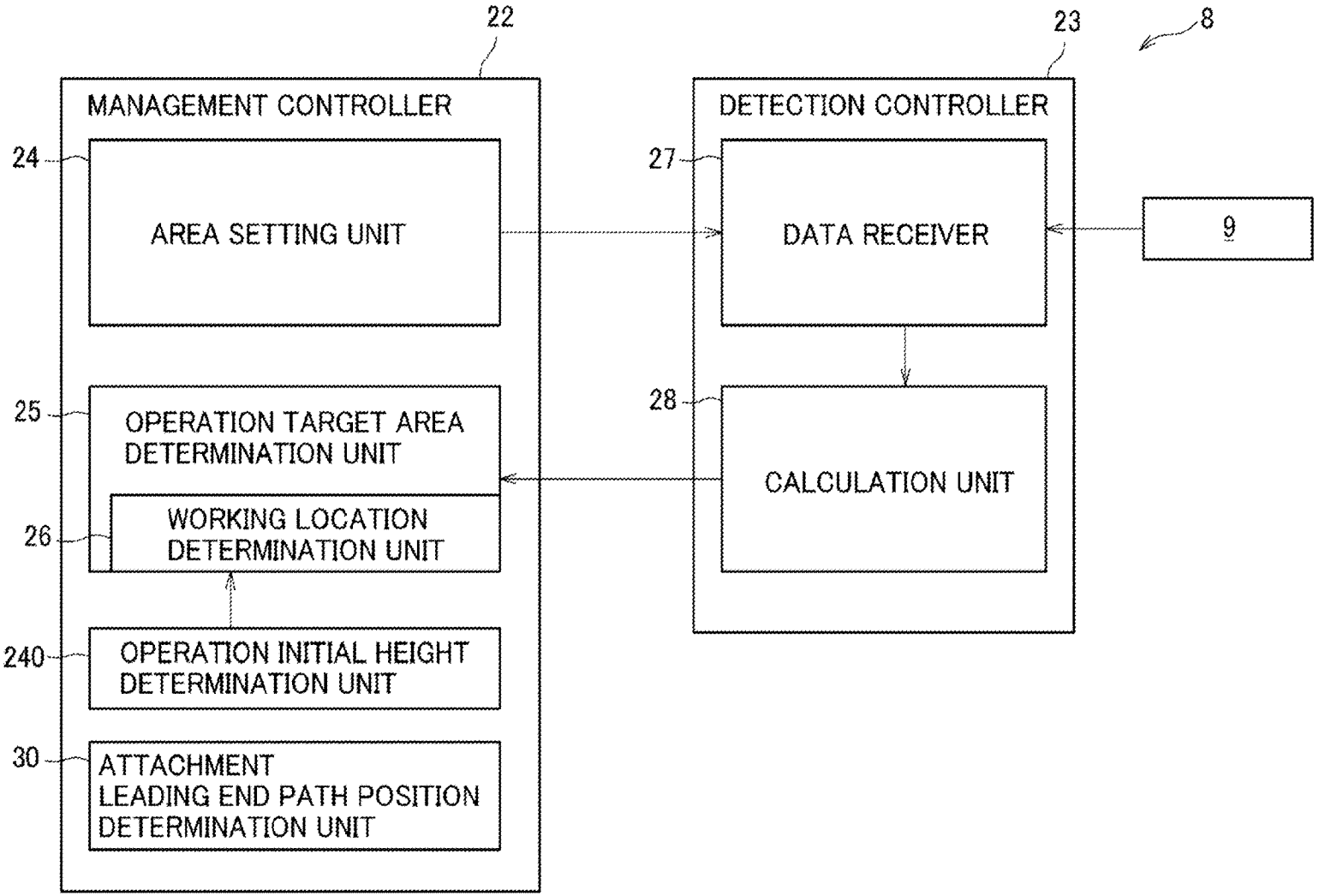
FIG. 11 corresponds to Second Embodiment and is equivalent to FIG. 4.
Figure 12:
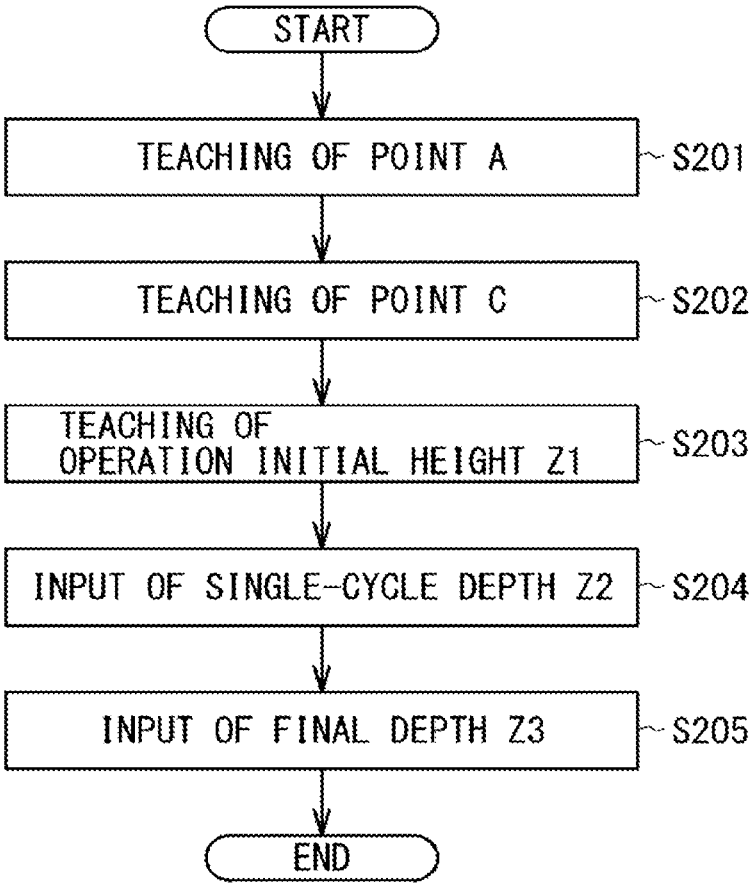
FIG. 12 is a flowchart of setting of parameters such as a working area shown in FIG. 9 and an operation initial height shown in FIG. 10.

The operation initial height Z1 is taught (S203 shown in FIG. 12). The operation initial height Z1 is the (initial) height of the excavation start point P5 when an operation (e.g., excavation) is performed for an operation target by the attachment 4 for the first time after a working area 50 shown in FIG. 9 is set. For example, by operating the attachment 4, the operator moves the leading end of the attachment 4 to a height at which the operation initial height Z1 is to be set (see FIG. 10). At this stage, the position of the leading end of the attachment 4 in plan view is optionally determined. As the operator then presses, for example, a confirmation button of the portable terminal 29, this position of the leading end of the attachment 4 is set as the operation initial height Z1. To be more specific, for example, the operation initial height determination unit 240 shown in FIG. 11 sets the operation initial height Z1 at the height of the position where the leading end of the attachment 4 shown in FIG. 10 is placed. Because the operation initial height Z1 is determined by the teaching in this way, the operation initial height Z1 is determined by actual operations performed by the operator. The operator is therefore able to grasp the operation initial height Z1. Furthermore, because the operation initial height Z1 is determined by the teaching, the operation initial height Z1 can be reliably set even when, for example, a pile of soil 100 cannot be easily detected by a three-dimensional measurement device 9 (see FIG. 11).

A single-cycle depth Z2 may be set by a controller 8 (see FIG. 11) (e.g., the calculation unit 28 (see FIG. 11)) (S204 shown in FIG. 12). The single-cycle depth Z2 is a depth of a single-cycle operation performed by the attachment 4. To be more specific, the single-cycle depth Z2 is a depth of excavation by the bucket 12. The controller 8 (see FIG. 11) may, for example, receive a value (numerical value) of a single-cycle depth Z2 input to the portable terminal 29 (see FIG. 9) and set the received value as the single-cycle depth Z2. (The same applies to a final depth Z3). The controller 8 may calculate the single-cycle depth Z2 based on information (e.g., volume and shape) regarding the bucket 12. The single-cycle depth Z2 may be a fixed value that is set in advance in the controller 8. (The same applies to the final depth Z3).

The final depth Z3 may be set by the controller 8 (see FIG. 11) (S205 shown in FIG. 12). The final depth Z3 is a depth when the attachment 4 finishes a series of operations (e.g., excavations that is repeated more than once). When the attachment 4 finishes the operation at the final depth Z3, all operations at the pile of soil 100 are finished. The final depth Z3 is a depth from a predetermined position (e.g., the point A).

(Determination of Excavation Start Point P5 by Working Location Determination Unit 26)

After a working area 50 shown in FIG. 9 is set, the working location determination unit 26 (see FIG. 11) determines the excavation start point P5 where an operation by the attachment 4 is performed for the first time (hereinafter, the initial position of the excavation start point P5). At this stage, the working location determination unit 26 shown in FIG. 11 receives the operation initial height Z1 (see FIG. 10) determined by the operation initial height determination unit 240 and sets the operation initial height Z1 shown in FIG. 10 as the height of the initial position of the excavation start point P5 (S210 shown in FIG. 13).

(Operation at Operation Initial Height Z1)

Subsequently, the controller 8 (see FIG. 11) causes the attachment 4 to perform the operation (e.g., excavation) at the operation initial height Z1. At this stage, the attachment 4 excavates the soil only by a single-cycle depth Z2 from the operation initial height Z1.

(Operation at Position Deeper than Operation Initial Height Z1)

When the operation at the operation initial height Z1 is completed, the controller 8 (see FIG. 11) causes the attachment 4 to perform an operation at a position deeper by a single-cycle depth Z2 than the operation initial height Z1 (i.e., an operation at the height Z1-Z2). For example, after an operation at the operation initial height Z1 is completed for the entirety of the pile of soil 100 (see FIG. 9) in plan view, an operation at the height Z1-Z2 may be performed. For example, after an operation at the operation initial height Z1 is completed for a part of the pile of soil 100 in plan view, an operation at the height Z1-Z2 may be performed. Likewise, the controller 8 (see FIG. 11) causes the attachment 4 to perform operations at gradually deeper positions, i.e., at positions that are different from each other in depth by the single-cycle depth Z2, until an operation is performed at the final depth Z3. The controller 8 does not cause the attachment 4 to perform operations at positions deeper than the final depth Z3.

(Correction of Operation Initial Height Z1)

As described above, the operation initial height Z1 is set by teaching. When a pile of soil 100 is flat or almost flat, the attachment 4 is able to properly perform an operation at the operation initial height Z1. On the other hand, there is a case where a pile of soil 100 exists at a position higher than the operation initial height Z1 (see a protruding portion 100*a* shown in FIG. 10). In such a case, when the attachment 4 tries to perform an operation at the excavation start point P5 which is at the operation initial height Z1, the attachment 4 may not be able to properly perform the operation at the excavation start point P5 which is at the operation initial height Z1 because the attachment 4 makes contact with the protruding portion 100*a* before reaching the excavation start point P5.

On this account, the working location determination unit 26 (see FIG. 11) determines whether the height of the excavation start point P5 is set at the operation initial height Z1 or at a height resulting from correction of the operation initial height Z1 (i.e., corrected operation initial height Z1*a*), based on the three-dimensional information calculated by the calculation unit 28 (see FIG. 11). This process will be detailed below. The working location determination unit 26 (see FIG. 11) compares the three-dimensional information calculated by the calculation unit 28 (see FIG. 11) with the operation initial height Z1 (S211 shown in FIG. 13). For example, the working location determination unit 26 compares, with the operation initial height Z1, the height of a pile of soil 100 at the excavation start point P5 shown in FIG. 10 and its peripheral portion, which is indicated in the three-dimensional information. For example, the working location determination unit 26 compares, with the operation initial height Z1, the height of the apex of the pile of soil 100 in the three-dimensional information (e.g., the height of the apex of a protruding portion 100*a*).

Figure 13:
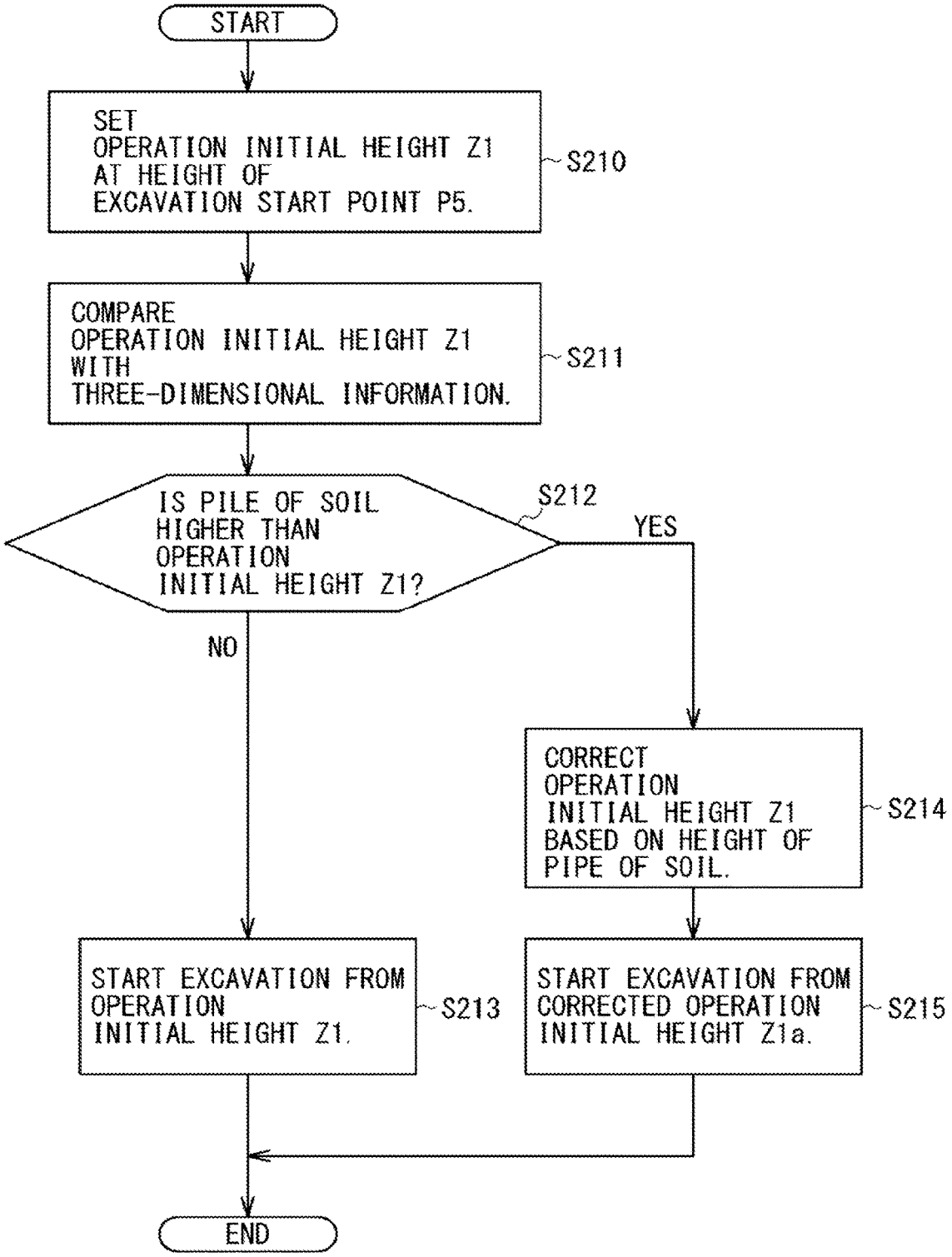
FIG. 13 is a flowchart of a process performed by a controller shown in FIG. 11.

The working location determination unit 26 (see FIG. 11) determines whether an operation at the operation initial height Z1 can be done at the excavation start point P5 (S212 shown in FIG. 13). For example, when the height of the pile of soil 100 at the excavation start point P5 shown in FIG. is equal to or lower than the operation initial height Z1, the operation at the excavation start point P5 at the operation initial height Z1 is possible. When the operation at the excavation start point P5 at the operation initial height Z1 is possible (NO in S212 in FIG. 13), the working location determination unit 26 sets the operation initial height Z1 as the height of the excavation start point P5. The controller 8 (see FIG. 11) then causes the attachment 4 to perform the operation at the excavation start point P5 at the operation initial height Z1 (S213 shown in FIG. 13).

On the other hand, for example, when the height of the pile of soil 100 (e.g., the protruding portion 100*a*) at the excavation start point P5 shown in FIG. 10 is higher than the operation initial height Z1, the operation at the excavation start point P5 at the operation initial height Z1 is not possible. When the operation at the excavation start point P5 at the operation initial height Z1 is not possible (YES in S212 shown in FIG. 13), the working location determination unit 26 (see FIG. 11) performs the following process. In this case, the working location determination unit 26 corrects the height of the excavation start point P5 based on the three-dimensional information of the pile of soil 100 (protruding portion 100*a*) shown in FIG. 10 (S214 shown in FIG. 13). To be more specific, the working location determination unit 26 (see FIG. 11) corrects the operation initial height Z1 shown in FIG. 10 (to corrected operation initial height Z1*a*) based on the three-dimensional information calculated by the calculation unit 28 (see FIG. 11). The working location determination unit 26 then sets the height of the excavation start point P5 at the corrected operation initial height Z1*a*. In this connection, for example, the working location determination unit 26 sets the corrected operation initial height Z1*a* at a height equal to or higher than the height of the pile of soil 100 (protruding portion 100*a*) at the excavation start point P5 in the three-dimensional information. For example, the working location determination unit 26 may set the corrected operation initial height Z1*a* at the height of the pile of soil 100 (protruding portion 100*a*) at the excavation start point P5 in the three-dimensional information. For example, the working location determination unit 26 may set the corrected operation initial height Z1*a* at the height of the apex of the pile of soil 100 (protruding portion 100*a*) in the three-dimensional information. The controller 8 (see FIG. 11) then causes the attachment 4 to start the operation at the corrected operation initial height Z1*a* (S215 shown in FIG. 13). On this account, the attachment 4 is able to properly perform the operation.

(Effects of Seventh Aspect of Invention)

[Arrangement 7] The operation target detection system includes the operation initial height determination unit 240 as shown in FIG. 11. The operation initial height determination unit 240 determines the operation initial height Z1 shown in FIG. 10. The operation initial height Z1 is the height of the excavation start point P5 (operation start point) when an operation is performed for a pile of soil 100 by the attachment 4 of the hydraulic excavator 1 (see FIG. 9) for the first time after the working area 50 (see FIG. 9) is set. The operation initial height determination unit 240 (see FIG. 11) sets the operation initial height Z1 at the height of the position where the leading end of the attachment 4 is placed.

In the [Arrangement 7] described above, the height of the position where the leading end of the attachment 4 is placed is set as the operation initial height Z1. On this account, when the operation initial height Z1 is set, the operation initial height Z1 can be determined by actual operations (teaching) performed by the operator. The operator is therefore able to grasp the operation initial height Z1. Furthermore, because the operation initial height Z1 can be determined by the teaching, the operation initial height Z1 can be reliably set even when, for example, a pile of soil 100 cannot be easily detected by the three-dimensional measurement device 9 (see FIG. 1).

(Effects of Eleventh Aspect of Invention)

[Arrangement 11-1] The operation target detection system includes the operation initial height determination unit 240 (see FIG. 11). The operation initial height determination unit 240 determines the operation initial height Z1 shown in FIG. 10. The operation initial height Z1 is the height of the excavation start point P5 (operation start point) when an operation is performed for a pile of soil 100 by the attachment 4 of the hydraulic excavator 1 (see FIG. 9) for the first time after the working area 50 (see FIG. 9) is set. The operation initial height determination unit 240 (see FIG. 11) sets the operation initial height Z1 at the height of the position where the leading end of the attachment 4 is placed.

[Arrangement 11-2] The working location determination unit 26 (see FIG. 11) determines whether the height of the excavation start point P5 is set at the operation initial height Z1 or at a height resulting from correction of the operation initial height Z1, based on the three-dimensional information calculated by the calculation unit 28 (see FIG. 11).

In the [Arrangement 11-1] described above, the height of the position where the leading end of the attachment 4 is placed is set as the operation initial height Z1. In this regard, there is a case where the operation initial height Z1 having been set is improper and a pile of soil 100 (e.g., protruding portion 100*a*) exists at a position higher than the operation initial height Z1, for example. In such a case, for example, the attachment 4 may not be able to properly perform the operation at the excavation start point P5 which is at the operation initial height Z1 because the attachment 4 makes contact with the protruding portion 100*a* before reaching the excavation start point P5. On this account, as in the [Arrangement 11-2] described above, the working location determination unit 26 (see FIG. 11) determines whether the height of the excavation start point P5 is set at the operation initial height Z1 or at a height resulting from correction of the operation initial height Z1, based on the three-dimensional information calculated by the calculation unit 28 (see FIG. 11). The working location determination unit 26 is therefore able to properly set the height of the excavation start point P5 based on the three-dimensional information. On this account, the attachment 4 is able to properly perform the operation.

(Modifications)

The above-described embodiments are changeable as follows. For example, elements of different embodiments may be combined. For example, the disposition and shape of each element may be changed. For example, the connection between the elements shown in FIG. 4 and FIG. 11 may be changed. For example, the order of the steps in the flowcharts shown in FIG. 5, FIG. 12, and FIG. 13 may be changed, and one or some of the steps may not be executed. For example, the number of elements may be changed, and one or some of the elements may not be provided. For example, the fixation or connection between elements may be performed directly or indirectly. For example, those described as different members or different parts may be a single member or part. For example, those described as a single member or part may be provided in a divided manner as plural members or parts.

At the leading end portion of the attachment 4, a pinching device (e.g., a grapple) or a device for crushing or excavation (e.g., a breaker) may be provided in place of the bucket 12 shown in FIG. 1. The grapple is a device configured to grab a scrap or lumber by closing plural (e.g., two or three) curved claws opposing one another.

The operation target may not be the pile of soil 100 and may be a pile of gravel, a pile of scraps, and a pile of rubber.

The working area 50 may not be rectangular in plan view. The working area 50 may be circular or elliptic, or may have a polygonal shape that is not rectangle.

In the embodiments above, a position where the leading end of the leading end of the attachment 4 (the claw leading end of the bucket 12) is placed is regarded as a point for specifying the border between the working area 50 and the outside of this area. Alternatively, by using drawing data of a workplace, the area setting unit 24 (see FIG. 4) may set a predetermine position in the drawing data as a point for specifying the border between the working area 50 (see FIG. 3) and the outside of this area. In this case, the drawing data is stored in the area setting unit 24, for example.

At least one of the elements of the working area setting system and the operation target detection system may be provided outside the hydraulic excavator 1. For example, at least one of the elements (e.g., the area setting unit 24 and the calculation unit 28) of the controller 8 shown in FIG. 4 and FIG. 11 may not be mounted on the hydraulic excavator 1.

REFERENCE SIGNS LIST

1 hydraulic excavator (working machine)
4 attachment
9 three-dimensional measurement device
24 area setting unit
26 working location determination unit

30 attachment leading end path position determination unit
50 working area
100 pile of soil (operation target)
240 operation initial height determination unit
P1 lifting turn start point (passing point)
P4 returning turn end point (passing point)
P5 excavation start point (operation start point)
Z1 operation initial height
Z1*a* corrected operation initial height

The invention claimed is:

1. A working area setting system comprising an area setting unit which is configured to set a working area, the working area being a predetermined range where an operation target of a working machine is stacked and which has a closed shape in plan view, and being data that is set and stored in the area setting unit.

2. The working area setting system according to claim 1, wherein, the area setting unit sets at least one position where a leading end of an attachment of the working machine is placed, as at least one point for specifying a border between the working area and an outside of the working area.

3. The working area setting system according to claim 2, wherein, the working area is rectangular in plan view.

4. The working area setting system according to claim 3, wherein, the remaining two points are determined based on a first position close to the working machine and a second position far from the working machine, the first and second points positions being positions where the leading end is placed.

5. The working area setting system according to claim 1, further comprising an attachment leading end path position determination unit which is configured to determine a passing point where the leading end of the attachment of the working machine passes when the leading end moves from an outside to an inside of the working area and/or the leading end moves from the inside to the outside of the working area.

6. The working area setting system according to claim 5, wherein, the attachment leading end path position determination unit is configured to set the passing point on a border between the working area and the outside of the working area in plan view.

7. The working area setting system according to claim 1, further comprising an operation initial height determination unit which is configured to determine an operation initial height that is the height of an operation start point where an operation for the operation target is performed by an attachment of the working machine for a first time after the working area is set, the operation initial height determination unit setting the height of a position where a leading end of the attachment is placed, as the operation initial height.

8. An operation target detection system comprising:

the working area setting system of claim 1;

a three-dimensional measurement device which is configured to obtain data of the operation target and surroundings of the operation target; and a calculation unit which is configured to calculate three-dimensional information regarding a position, a range, and a shape of the operation target in the working area, based on the measurement data obtained by the three-dimensional measurement device.

9. The operation target detection system according to claim 8, wherein, when the operation target spreads across an outside of the working area and the working area, the calculation unit calculates the three-dimensional information of only a part of the operation target, which exists inside the working area.

10. The operation target detection system according to claim 8, further comprising a working location determination unit which is configured to determine an operation start point of the operation target based on the three-dimensional information calculated by the calculation unit.

11. An operation target detection system, comprising:

an area setting unit which is configured to set a predetermined range of a working area where an operation target of a working machine is stacked;

a three-dimensional measurement device which is configured to obtain data of the operation target and surroundings of the operation target;

a calculation unit which is configured to calculate three-dimensional information regarding a position, a range, and a shape of the operation target in the working area, based on the measurement data obtained by the three-dimensional measurement device; and a working location determination unit which is configured to determine an operation start point of the operation target based on the three-dimensional information calculated by the calculation unit, the operation target detection system further comprising an operation initial height determination unit which is configured to determine an operation initial height that is the height of the operation start point where an operation for the operation target is performed by an attachment of the working machine for a first time after the working area is set, the operation initial height determination unit setting the height of a position where a leading end of the attachment is placed, as the operation initial height, and the working location determination unit determining whether the height of the operation start point is set at the operation initial height or a height resulting from correction of the operation initial height, based on the three-dimensional information calculated by the calculation unit.

* * * * *